US006772705B2

(12) United States Patent
Leonard et al.

(10) Patent No.: US 6,772,705 B2
(45) Date of Patent: Aug. 10, 2004

(54) VARIABLE BUOYANCY APPARATUS FOR CONTROLLING THE MOVEMENT OF AN OBJECT IN WATER

(76) Inventors: Kenneth J. Leonard, 13507 Riverton Dr., Midlothian, VA (US) 23113; John Engel, 914 Begonia Ct., Carlsbad, CA (US) 92009

( * ) Notice: Subject to any disclaimer, the term of this patent is extended or adjusted under 35 U.S.C. 154(b) by 0 days.

(21) Appl. No.: 10/253,987

(22) Filed: Sep. 25, 2002

(65) Prior Publication Data

US 2003/0075096 A1 Apr. 24, 2003

Related U.S. Application Data

(60) Provisional application No. 60/325,206, filed on Sep. 28, 2001.

(51) Int. Cl.[7] ..... B63G 8/22
(52) U.S. Cl. ..... 114/333
(58) Field of Search ..... 114/330, 331, 114/333, 52, 54; 405/185, 186, 192, 193; 137/1, 81.2

(56) References Cited

U.S. PATENT DOCUMENTS

| | | | | | |
|---|---|---|---|---|---|
| 3,228,369 | A | | 1/1966 | Warhurst et al. | 114/330 |
| 3,520,263 | A | | 7/1970 | Berry et al. | 114/330 |
| 3,952,349 | A | * | 4/1976 | Erath et al. | 114/331 |
| 4,029,034 | A | * | 6/1977 | Mason | 114/333 |
| 4,202,036 | A | | 5/1980 | Bowditch et al. | 364/420 |
| 4,266,500 | A | | 5/1981 | Jurca | 114/333 |
| 4,336,590 | A | * | 6/1982 | Jacq et al. | 128/204.21 |
| 4,674,429 | A | * | 6/1987 | Buckle et al. | 114/333 |
| 4,790,345 | A | * | 12/1988 | Kolchinsky | 137/269 |
| 4,850,394 | A | * | 7/1989 | Imhof et al. | 137/554 |
| 5,007,364 | A | * | 4/1991 | Buckle | 114/331 |
| 5,129,348 | A | * | 7/1992 | Rannenberg et al. | 114/333 |
| 5,283,767 | A | | 2/1994 | McCoy | 367/4 |
| 5,379,267 | A | | 1/1995 | Sparks et al. | 367/18 |
| 5,482,405 | A | | 1/1996 | Tolksdorf et al. | 409/186 |
| 5,496,136 | A | | 3/1996 | Egan | 409/186 |
| 6,142,092 | A | | 11/2000 | Coupland | 114/331 |
| 6,237,617 | B1 | * | 5/2001 | Sturman et al. | 137/1 |

FOREIGN PATENT DOCUMENTS

| | | |
|---|---|---|
| DE | 4125407 | 9/1992 |
| JP | 03-2911 | 1/1991 |

* cited by examiner

*Primary Examiner*—S. Joseph Morano
*Assistant Examiner*—Lars Olson
(74) *Attorney, Agent, or Firm*—Jacobson Holman PLLC

(57) ABSTRACT

A device controlling the depth and motion of an object underwater by using a processor to accurately control the volume of gas within, and thereby the buoyancy, depth, and motion (rate of ascent and descent) of, a buoyancy chamber that is attached to the object. The device has a central component incorporating a processor and associated memory, the processor being in communication with: a buoyancy chamber and a means for measuring the volume or level of gas within, at least one gas control mechanism(s) to input and remove gas from the buoyancy chamber; a depth measuring sensor, a power source; a gas source, and an input device to instruct the processor. By manipulating the volume of gas within the buoyancy chamber, using the gas source and the at least one gas control mechanism(s), the processor is able to control the rate of ascent, rate of descent, level of buoyancy, and depth of itself and the object to which it is attached. Upon receiving instructions from the input device, the processor initializes control. At regular intervals the processor will process sensor readings, determine the volume of gas within the buoyancy chamber, and determine depth and ascent or descent rate. It will then compare these values to acceptable values based on the instruction received, and make corrections to the volume of gas using the at least one gas control mechanism(s). The corrections will be determined by calculations involving algorithms, the sensor readings, recalculations several times each second, and the results of previous corrections.

15 Claims, 2 Drawing Sheets

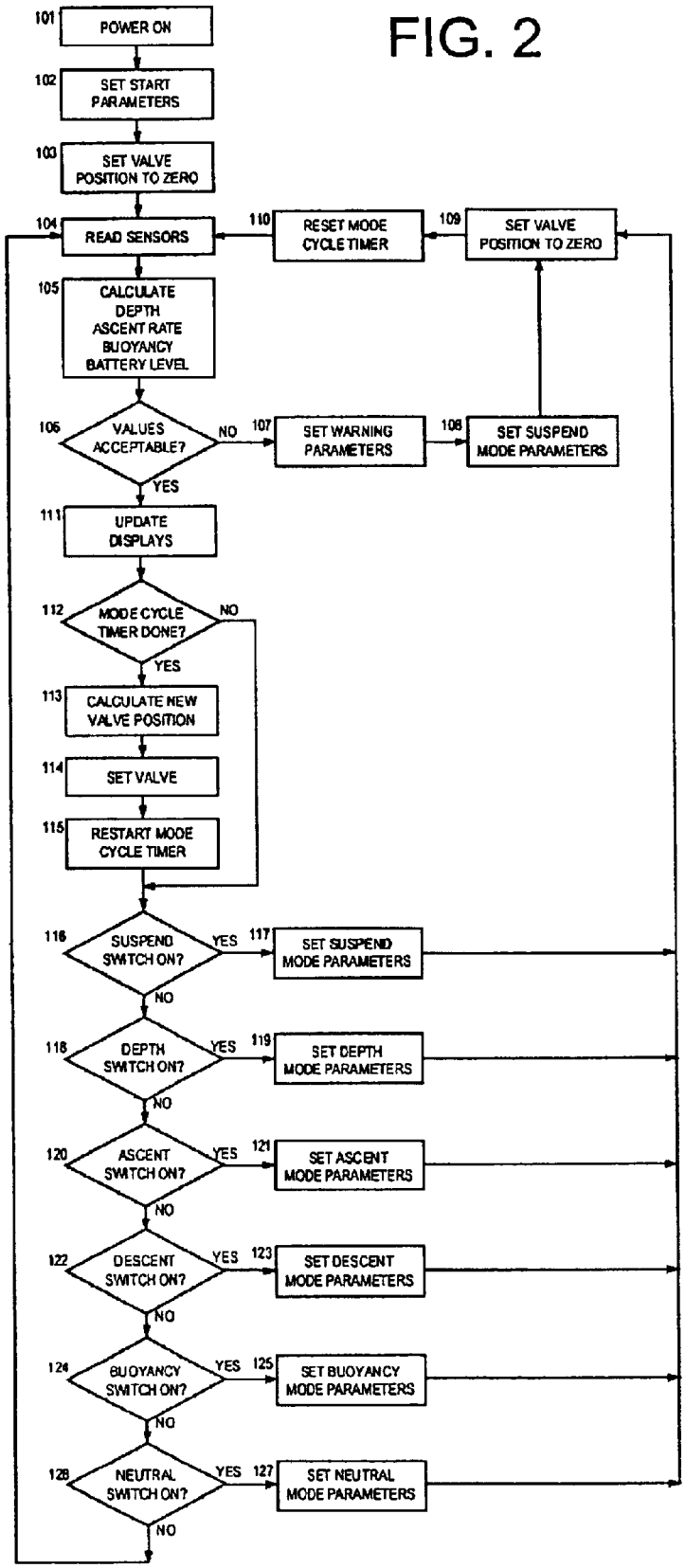
FIG. 2
101 POWER ON
102 SET START PARAMETERS
103 SET VALVE POSITION TO ZERO
104 READ SENSORS
105 CALCULATE DEPTH ASCENT RATE BUOYANCY BATTERY LEVEL
106 VALUES ACCEPTABLE?
NO
YES
107 SET WARNING PARAMETERS
108 SET SUSPEND MODE PARAMETERS
109 SET VALVE POSITION TO ZERO
110 RESET MODE CYCLE TIMER
111 UPDATE DISPLAYS
112 MODE CYCLE TIMER DONE?
113 CALCULATE NEW VALVE POSITION
114 SET VALVE
115 RESTART MODE CYCLE TIMER
116 SUSPEND SWITCH ON?
117 SET SUSPEND MODE PARAMETERS
118 DEPTH SWITCH ON?
119 SET DEPTH MODE PARAMETERS
120 ASCENT SWITCH ON?
121 SET ASCENT MODE PARAMETERS
122 DESCENT SWITCH ON?
123 SET DESCENT MODE PARAMETERS
124 BUOYANCY SWITCH ON?
125 SET BUOYANCY MODE PARAMETERS
126 NEUTRAL SWITCH ON?
127 SET NEUTRAL MODE PARAMETERS

VARIABLE BUOYANCY APPARATUS FOR CONTROLLING THE MOVEMENT OF AN OBJECT IN WATER

CROSS-REFERENCE TO RELATED APPLICATIONS

The present patent application is based on, and claims priority from, U.S. provisional Application No. 60/325,206, filed Sep. 28, 2001, which is incorporated herein by reference in its entirety.

BACKGROUND OF THE INVENTION

1. Field of the Invention

The present invention relates to controlling the depth and motion of an object underwater by using a processor to accurately control the volume of gas within, and thereby the buoyancy, depth, and motion (rate of ascent and descent) of, a buoyancy chamber that is attached to the object.

2. Related Art

Buoyancy control of an object underwater is used herein to refer to change in the buoyancy of the object as needed to accomplish a desired action on the object. Current methods of changing the buoyancy of objects underwater include releasing weights, pumping a liquid to displace water in a chamber, manually controlling gas within a chamber to displace water, and mechanically controlling the volume of gas within a chamber to displace water. All of these methods are very limited in providing the desired actions on the object. Limitations include single use, requirement of direct operator control, ability to control only one condition of buoyancy, and small amounts of buoyancy change for the volume of water being displaced. These limitations are significant factors in using these methods while operating underwater.

Other examples of prior art disclosing methods of controlling buoyancy include U.S. Pat. No. 6,142,092 (Coupland), U.S. Pat. No. 5,496,136 (Egan), U.S. Pat. No. 5,482,405 (Tolksdorf et al.), U.S. Pat. No. 5,379,267 (Sparks et al.), U.S. Pat. No. 5,283,767 (McCoy), U.S. Pat. No. 4,266,500 (Jurca), U.S. Pat. No. 4,202,036 (Bowditch et al.), U.S. Pat. No. 3,520,263 (Berry et al.), U.S. Pat. No. 3,228,369 (Warhurst et al.), German Patent No. DE 4,125,407 A1 (Fismer), and Japanese Patent No. JP 03-2911 (Ishitani), and U.S. Pat. No. 5,746,543 (Leonard).

U.S. Pat. No. 6,142,092 (Coupland) discloses a three-chambered, variable-volume buoyant body operating under the control of a depth controller.

U.S. Pat. No. 5,496,136 (Egan) discloses an automatic buoyancy compensator using a flexible air bladder.

U.S. Pat. No. 5,482,405 (Tolksdorf et al.) discloses a device for controlling at least one valve for admitting air into or releasing air from a life jacket for regulating diver depth.

U.S. Pat. No. 5,379,267 (Sparks et al.) discloses a buoyancy control system with first and second bladders is for maintaining a buoyant vehicle at a controlled depth by jettisoning either a heavy liquid or a light liquid.

U.S. Pat. No. 5,283,767 (McCoy) discloses an oceanographic instrument package with a dive control system including a microprocessor-controlled trim piston and cylinder.

U.S. Pat. No. 4,266,500 (Jurca) discloses a compressed fluid hover control system for a submersible buoy in which the water level in a buoyancy chamber is controlled in accordance with external water pressure and predetermined water levels in the buoyancy chamber. Both the gas inlet and gas exhaust valves for admitting and exhausting air from the chamber are controlled by an electronic circuit including a water pressure transducer.

U.S. Pat. No. 4,202,036 (Bowditch et al.) discloses a programmed microprocessor system for controlling the buoyancy of a neutrally buoyant instrument platform.

U.S. Pat. No. 3,520,263 (Berry et al.) discloses a constant depth control system for an ocean vehicle by adjusting the displacement of a rubber gas bag to achieve neutral buoyancy.

U.S. Pat. No. 3,228,369 (Warhurst et al.) discloses a system using a differential liquid density technique to adjust the buoyancy of a vessel.

German Patent No. DE 4,125,407 A1 (Fismer) discloses a diver's buoyancy controller in which air is admitted and exhausted from an inflatable vest by electromagnetic valves controlled by a microprocessor.

Japanese Patent No. JP 03-2911 (Ishitani) discloses a system for controlling buoyancy using a fuzzy inference means.

U.S. Pat. No. 5,746,543 (Leonard) discloses a volume control module for controlling the air volume within the chamber of a buoyancy compensator apparatus for diving. The volume control module controls the volume of a fluid such as air in a buoyancy chamber of a buoyancy compensator device such as a buoyancy compensator vest comprises a main unit and a selector pad.

U.S. Pat. No. 5,746,543 (Leonard) is designed to be an add on device to existing buoyancy compensator apparatus for use in diving, not an independent variable buoyancy apparatus consisting of all the necessary components needed to provide control of the depth and motion of an object underwater.

It is to the solution of these and other problems that the present invention is directed.

SUMMARY OF THE INVENTION

It is a primary object of the present invention to provide a device in which the volume of gas within a chamber is controlled by a processor, for the purpose of controlling the depth, motion, and buoyancy of the chamber and an object in water to which the chamber is attached.

It is another object of the present invention to provide a device in which the volume of gas within a chamber is controlled by a processor, for the purpose of monitoring and automatically adjusting the volume of gas within the buoyancy chamber in response to changes in depth and motion or external forces.

It is still another object of the present invention to provide a device in which the volume of gas within a chamber is controlled by a processor, where the processor is programmable by the user. It is still another object of the present invention to provide a device in which the volume of gas within a chamber is controlled by a processor, in response to various operational modes selected by the user.

These and other objects of the invention are achieved by the provision of a device that, through a processor and associated memory, has programmed control of the volume of gas within a chamber, for the purpose of controlling the depth, motion, and buoyancy of the chamber and the depth and motion of an object in water associated with the chamber, the processor being in communication with: the buoyancy chamber, a means for measuring the volume or level of gas within the buoyancy chamber, at least one gas control mechanism to add gas to and remove gas from the buoyancy chamber, a depth measuring sensor, a power source, a gas source, and an input device to provide instructions to the processor.

The device has a central or primary component that incorporates the processor and associated memory, the processor being in communication with the means for measuring the volume of gas within the buoyancy chamber, at least one gas control mechanism, a depth measuring sensor, a gas source, and a power source. The processor is programmed via programming code stored in the associated memory, so as to perform operations and control the gas volume in the buoyancy chamber, so as to accomplish the instructed action. The processor will receive information at regular intervals regarding current depth, ascent or descent rate, acceleration, and gas volume in the buoyancy chamber. This information will be used to determine the operation of the at least one gas control mechanism through computations involving algorithms, the results of previous actions, program parameters, and the desired results.

The buoyancy chamber contains the gas being used to displace the water within the chamber so that the depth and motion of the object can be controlled. The means for determining the volume of gas within the chamber can operate through direct measurement of the gas volume, or the determination of the gas-water interface which is then used to calculate the gas volume. This information is used in computations by the processor.

The at least one gas control mechanism is used to add gas to and remove gas from the buoyancy chamber. It is controlled by the processor and is normally in the closed position. The at least one gas control mechanism is in direct communication with the buoyancy chamber. The at least one gas control mechanism can open to permit the passage of gas dependent on pressure differences, or be able to pump the gas in the desired direction.

The depth measuring sensor provides the processor with readings of the ambient pressure on a regular basis. This information is used in computations by the processor.

The power source is in communication with the processor, the means for measuring the water level, the at least one gas control mechanism, the depth measuring device, and the user input device as needed. Power can be supplied by batteries or delivered by electrical connection from an outside source.

The gas source is in communication with the at least one gas control mechanism, which allows gas to flow into the buoyancy chamber. The gas can be stored under pressure in storage tanks, or delivered to the system from an external source. The gas is used to displace water within the buoyancy chamber to control the depth, motion, and buoyancy of the chamber along with the depth and motion of the object to which the chamber is attached.

The user input device is in communication with the processor and is used to provide the processor with instructions to carry out the desired action. The selections available to the user may include: maintain current depth, maintain current buoyancy, ascend at a particular rate, descend at a particular rate, achieve neutral buoyancy, or suspend operations. The processor will operate the at least one gas control mechanism as determined by the program code to accomplish the instruction.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 2 is a flow chart of the programming of the processor.

DETAILED DESCRIPTION OF THE PREFERRED EMBODIMENTS

Figure 1:
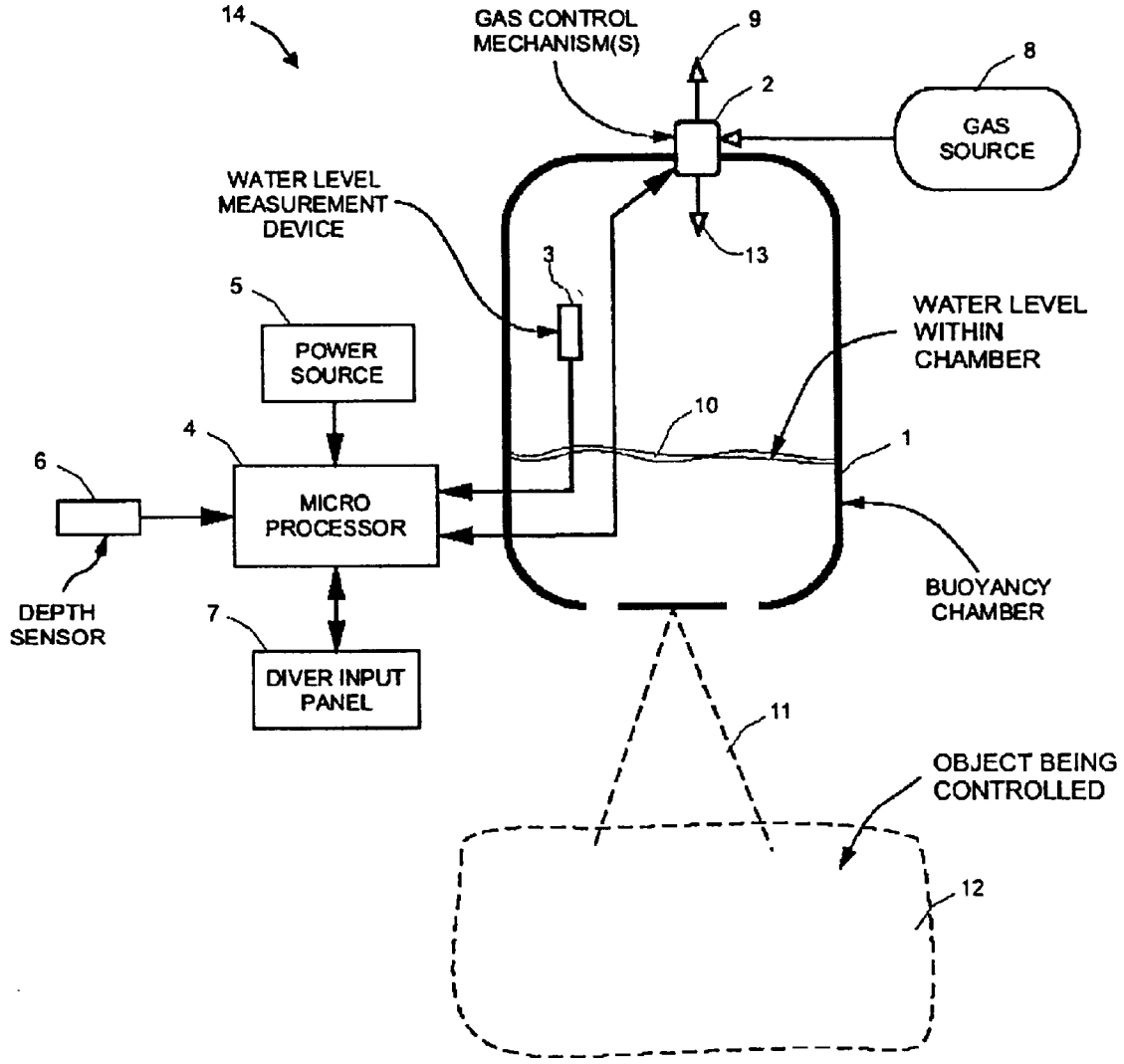
FIG. 1 is a block diagram of the components for operation of the device.

In describing preferred embodiments of the present invention illustrated in the drawings, specific terminology is employed for the sake of clarity. However, the invention is not intended to be limited to the specific technology so selected, and it is to be understood that each specific element includes all technical equivalents that operate in a similar manner to accomplish a similar purpose.

Referring to FIG. 1, there is shown a block diagram of a depth, motion, and buoyancy device 14 in accordance with the present invention, illustrating the relationships between its components, and the gas flow to and from its components. The device 14 comprises a central component that includes a programmed processor 4 (which can be part of a computer or a microprocessor, the programming for which is provided by code stored in an associated memory, not shown) and a buoyancy chamber 1, the gas flow to and from the buoyancy chamber 1 being particularly illustrated. The processor 4 has an associated memory for storing the program code it carries out, and may also be programmable.

The buoyancy chamber 1 is an ambient pressure container into which gas is added or removed. As the gas volume is controlled, water is displaced accordingly. The chamber 1 can be a rigid container open to the water, as shown, a flexible container open to the water, or a flexible container closed to the water.

At least one gas control mechanism 2 allows gas to be added to or removed from the buoyancy chamber 1. The gas control mechanism 2 does this by controlling the flow of gas from the gas source 8 into the buoyancy chamber 1 (as indicated by arrow 13), and controlling the flow of gas out of the buoyancy chamber 1 (as indicated by an arrow 9) into the surrounding water. In the normally closed position, the gas control mechanism 2 will prevent gas flow in either direction. It receives signals or commands from the processor 4. In one embodiment of the invention, the gas control mechanism 2 is a two way, variable-orifice, proportional valve that is mounted on the buoyancy chamber 1. Other valve designs, such as single or multiple solenoid valves, single or multiple proportional valves, or single or multiple valves capable of measuring the gas flow through them, can be used as well.

As gas is added to the buoyancy chamber 1 and water is displaced out of the chamber 1, the water level 10 will move accordingly. The water level 10, detected by a water level measurement device 3, is used to compute the gas volume. In one embodiment of the invention, the water level measurement device 3 is a linear displacement sensor operating on magnetostrictive linear displacement technology, and is structurally mounted within the buoyancy chamber 1. Other types of sensors can also be used to detect the water level, including but not limited to magnetic, resistive, inductive, or capacitive float sensors, mechanical float sensors, acoustic water level sensors, optical water level sensors, or radar water level sensors. Likewise, other measurement schemes, such as measurement of the differential pressures between the top and bottom of the chamber 1, can be employed to determine the gas volume without the need to detect the water level. Likewise the gas volume can be calculated directly by volume measuring sensors, including but not limited to sensors that use, ultrasound, radar, or optics; and can be calculated by the running total volume by measuring the flow of gas through the valves.

The processor 4 receives signals from a depth sensor 6 (which measures the depth of the chamber 1, or the distance to a surface using a directional sonar altimeter), the water level measurement device 3, the gas control mechanism 2, and an operator input panel 7. It also receives power from a power source 5. The processor 4 sends signals and power to the gas control mechanism 2, commanding it to go to a new valve position. The processor 4 also sends power to the operator input panel 7, as well as signals indicative of critical data such as current depth, buoyancy, and ascent rate. The operator input panel 7 includes an LED or LCD digital display (not shown), or other suitable display for displaying the critical data represented by the signals, and illuminating lights or other suitable means to denote the mode of operation. Other processor means can be used, including but not limited to integrated circuits or an electronic device capable of storing and processing information in accordance with a predetermined set of instructions. The processor 4 has sufficient associated memory and computing capacity to implement the instructions and operational modes for which it has been programmed. The signals between the processor and the other components can include, but are not limited to digital signals delivered using hard wire or fiber optic cables, analog signals delivered using hard wire or fiber optic cable, radio frequency signals, optical signals, and acoustic signals.

The operator input panel 7 also has an on/off power control switch, and various push button switches for selection of the desired operation mode. Push buttons allow the diver to select among a "Maintain Current Depth" mode, an "Ascend at a Constant Rate" mode, a "Descend at a Constant Rate" mode, an "Achieve Neutral Buoyancy" mode, and a "Maintain Current Buoyancy" mode, while another button allows the diver to suspend automatic operation altogether. There are also push buttons that allow the diver to modify or adjust the target values of depth, buoyancy, or ascent/descent rates when operating in one of the automatic modes. The operator input panel 7 can be directly connected to the device using electrical cable, or can communicate using an acoustic or optical link where the operator may not be in direct contact with the device.

The object 12 being controlled is connected or attached to the device 14 by means of clasps, hooks, netting, cables, ropes, or straps 11, or by other direct attachment mechanisms. Attachment can also be accomplished by the use of an active mechanical connection, such as a mechanical arm, attached to either the object 12 or the device 14. Likewise the object 12 can be placed on the device and simply carried in a static position within a basket or shelf.

By manipulating the volume of gas within the buoyancy chamber 1, using the gas source 8 and the at least one gas control mechanism 2, the processor 4 is able to control the rate of ascent, rate of descent, level of buoyancy, and depth of itself and the object 12 to which it is attached. Upon receiving instructions from the input device 7, the processor 4 initializes control in accordance with the code stored in its associated memory. At regular intervals the processor 4 will process sensor readings, determine the volume of gas within the buoyancy chamber 1, and determines the depth, the ascent or descent rate, and the ascent or descent acceleration. It will then compare these values to acceptable values stored in its associated memory, based on the instruction received, and make corrections to the volume of gas using the at least one gas control mechanism 2. The corrections will be determined by calculations involving algorithms, the sensor readings, recalculations several times each second, and the results of previous corrections.

Referring still to FIG. 1, as well as to the sequence of steps shown in FIG. 2, a brief narrative will now be given on how the invention works. In this narrative it will be assumed that the diver wishes to lift, move, or transport an object 12 from the bottom of the ocean (or other body of water) to the surface, from the surface to the ocean bottom, or simply wants to move an object from one depth or location to another depth or location. It will also be assumed that the diver is in the water, with the device 14, and has attached or secured the device 14 to the object 12 to be moved.

Upon being turned on and receiving power in step 101, the processor 4 retrieves from memory a pre-recorded set of starting parameters in step 102. These initial starting parameters include setting the operational mode to "Suspend," setting sensor calibration factors, and setting other default parameters. The default parameters are parameters such as normal ascent or descent rate, maximum permissible depth and buoyancy, cycle time durations for the different modes, and minimum power supply voltage allowable.

In step 103, the processor 4 then instructs the gas control mechanism 2 to go to the closed or zero position. In this position there is neither gas flow into or out of the buoyancy chamber 1.

In step 104 the processor 4 reads the signals from the depth sensor 6 and the water level measurement device 3, and the voltage from the power source 5.

Proceeding to step 105, the processor 4 performs the necessary calculations to determine depth, ascent or descent rate, gas volume, and power source voltage. In step 106 the processor 4 compares the calculated values to acceptable values stored in memory.

If the calculated values are determined to be unacceptable, the processor 4 then proceeds along a path that includes steps 107, 108, 109, and 110, in which it respectively sets the warning parameters, sets the system to "Suspend" mode, instructs the gas control mechanism 2 to go to the closed or zero position, and resets the cycle mode.

If, however, the values calculated in step 105 are determined to be acceptable, the processor 4 proceeds to step 111. In step 111, the processor 4 sends the correct signals to the operator input panel 7, causing the correct panel light(s) to be illuminated, and displays the current depth and buoyancy levels.

In step 112 the processor 4 determines if the cycle timer has expired, and if not, proceeds on to step 116. In the "Suspend" mode, the cycle timer has no maximum value and therefore, while in "Suspend" mode, the processor 4 always proceeds on to step 116.

In steps 116, 118, 120, 122, 124, and 126, the processor 4 determines if the diver has pressed any one of the push button switches. If no switch closure is detected, the processor 4 proceeds back to step 104, to begin the process again, while remaining in whatever mode was previously set.

As the processor 4 operates at multiple cycles per second, even a momentary push button switch closure by the diver will be detected. Should a switch closure be detected, the processor 4 proceeds immediately to one of steps 117, 119, 121, 123, 125, or 127 according to which switch is detected. In these steps the current mode parameters are replaced with those pertaining to the new mode selection. The processor 4 then proceeds on to steps 109 and 110, in which the gas control mechanism 2 is instructed to go to the zero or closed position, and the cycle timer is reset. Following step 110, the processor 4 returns to step 104 to begin the normal cycle again.

If during step 112 the processor 4 determines that the cycle timer has expired, it proceeds onto step 113. In this last step the processor 4 uses the newly calculated values for depth, ascent or descent rate, acceleration, and buoyancy, and calculates what changes are needed, if any, to the buoyancy chamber 1 gas volume, in order to best achieve the desired results of the particular operational mode. The end result of step 113 is the calculation of a new position for the gas control mechanism 2.

The calculations performed in step 113 make use of pre-programmed, specialized control algorithms that involve not only the difference between current and target values, but actions taken and corresponding results obtained during the previous one or more cycles. The algorithms used for each operational mode are different, and each algorithm itself is modified slightly depending upon depth and level of buoyancy. The determination of suitable algorithms can readily be accomplished by a person of ordinary skill and knowledge in the art of dynamic controls or control engineering.

In step 114 the processor 4 instructs the at least one gas control mechanism 2 to go to the new position determined in the previous step.

From step 114 the processor 4 resets the mode cycle timer in step 115, and then moves on to detect the diver input switches as discussed earlier.

The depth, motion, and buoyancy device 14 in accordance with the invention can be employed in a variety of applications. For example, a diver can attach the device 14 to an object, for the purpose of moving the object underwater. Once the device 14 is attached, the diver can use it to lift the object to a desired depth, then maintain the combined buoyancy of the device 14 and the object while moving it, finally releasing the object when it is in the desired position. In a similar manner, the device 14 can be employed to maintain the object at a desired depth, or transport the object to the surface, or assist in lowering the object from the surface to a desired depth.

A Remotely Operated Vehicle ("ROV") can use the device 14 to assist in moving an object. The ROV would provide the force needed to move the object horizontally, while the device would provide some or all of the vertical force necessary to move the object. The ROV would also control the device 14, for example, by moving levers on the device 14 or operator input panel 7. Alternatively, an electrical connection can be provided between the ROV operator and the device 14.

The device 14 also can be incorporated into the ROV. This would provide the ROV with greater lift capability. The combined ROV/device 14 unit would be controlled by the operator of the ROV unit.

The device 14 can be controlled by a surface operator. The input panel 7 for communicating with the processor 4 would be located separate from the device 14, with signals between the processor 4 and the input panel being sent via a hard wire connection, radio, acoustic, or optical signal, or any other acceptable method.

The device 14 also can be employed in situations where the gas source is delivered from a remote source, not carried as part of the device 14; and/or where the power source is delivered from a remote source, not carried as part of the device 14.

The device 14 can be part of a platform that operates independently, as in the case of Autonomous Underwater Vehicles (AUVs). AUVs follow a pre-programmed series of operations based on processor control and often use artificial intelligence. The device 14 would not be providing the overall control of the AUV but would be another component of the AUV itself. The device 14 would control the depth, ascent or descent, and buoyancy of the AUV at the direction of the overall AUV control system.

A single device 14 can control singular or multiple, independent buoyancy chambers. This application would be beneficial for controlling a large object that would serve as the buoyancy chamber itself or in maintaining a desired orientation or the attitude of the object by using multiple buoyancy chambers attached at different locations on the object.

The device 14 can be provided as an Original Equipment Manufacturer component and incorporated into another unit. The device 14 would provide buoyancy control and operate in association with other components to provide the desired control of the device 14.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. Apparatus having variable buoyancy for controlling the depth and motion of an object in water, comprising:

a buoyancy chamber configured to hold a volume of gas, wherein the buoyancy chamber is an ambient pressure container;

gas control means for adding gas to and removing gas from the buoyancy chamber;

processor means for receiving signals from and sending signals to the gas control means for controlling the volume of gas within the buoyancy chamber in order to control the buoyancy, depth, and motion of the buoyancy chamber and an object associated with the buoyancy chamber;

volume-determining means for determining the volume of gas within the buoyancy chamber and providing signals to the processor indicative of the volume;

depth-determining means for determining the depth of the buoyancy chamber and providing signals to the processor indicative of the depth; and input means for allowing a user to input instructions to the processor, the input means receiving signals from and sending signals to the processor.

2. The apparatus of claim 1, further comprising display means for displaying information based on the signals received by the processor from the volume-determining means and the depth-determining means.

3. The apparatus of claim 1, wherein the gas control means is a two way, variable orifice, proportional valve.

4. The apparatus of claim 1, further comprising memory means for storing operational parameters for loading into the processor.

5. The apparatus of claim 1, wherein the volume-determining means determines the volume of gas by detecting a level of water in the buoyancy chamber.

6. The apparatus of claim 1, wherein the volume-determining means determines the volume of gas by measuring differential pressures between the top and bottom of the chamber.

7. The apparatus of claim 1, wherein the volume-determining means determines the volume of gas by directly measuring the volume of gas.

8. The apparatus of claim 1, wherein the instructions that can be input by the input means include maintain current depth, maintain current buoyancy, ascend at a particular rate, descend at a particular rate, achieve neutral buoyancy, and suspend operations.

9. The apparatus of claim 8, wherein the input means further functions to allow the user to modify or adjust the target values of depth, buoyancy, or ascent/descent rates when operating in one of the operation modes.

10. The apparatus of claim 1, further comprising means for attaching the chamber with an object, the depth and motion of which are to be controlled.

11. A depth, motion, and buoyancy device comprising:

a buoyancy chamber, wherein the buoyancy chamber is an ambient pressure container;

gas control means for adding gas to and removing gas from the container;

water level means for detecting a level of water in the container and outputting a signal indicative of the water level;

depth means for determining the depth of the container and outputting a signal indicative of the depth;

processor means for receiving the signals output by the water level means and the depth means, calculating gas volume within the container, and ascent or descent rate based thereon, comparing the gas volume within the chamber, the depth, and the ascent or descent rate to acceptable values, based on the instruction received, and sending command signals to the gas control means based on the calculated gas volume, and ascent or descent rate for controlling the volume of gas withing the buoyancy chamber in order to control the buoyancy, depth, and motion of the buoyancy chamber and an object associated with the buoyancy chamber; and input means in communication with the processor means for allowing a user to select an operation mode of the apparatus for controlling the buoyancy, depth, and motion of the object.

12. The apparatus of claim 11, wherein the operations modes that can be selected by the user with the input means include maintain current depth, maintain current buoyancy, ascend at a particular rate, descend at a particular rate, achieve neutral buoyancy, and suspend operations.

13. The apparatus of claim 12, wherein the input means further functions to allow the user to modify or adjust the target values of depth, buoyancy, or ascent/descent rates when operating in one of the operation modes.

14. A method of controlling the depth and motion of an object in water, using apparatus associated with the object including a buoyancy chamber that is an ambient pressure container, water level means for determining a level of water within the buoyancy chamber, gas control means for adding gas to and removing gas from the buoyancy chamber; a depth measuring sensor for determining the depth of the buoyancy chamber, a power source, a gas source, a processor, and an input device to send instructions to the processor, the processor being in communication with the water level means, the gas control means, the depth measuring sensor, the power source, and the input device, the method comprising the steps of:

using the processor to initialize control of the gas control means in response to instructions received from the input device;

at regular intervals using the processor to process readings from the water level and the depth measuring sensor to determine the volume of gas within the buoyancy chamber, and to determine depth and ascent or descent rate;

using the processor to compare the volume of gas within the buoyancy chamber, the depth, and the ascent or descent rate to acceptable values based on the instruction received; and using the processor to control the gas control means, based on corrections, to manipulate the volume of gas within the buoyancy chamber to control the rate of ascent, rate of descent, level of buoyancy, and depth of the buoyancy chamber and the object.

15. The method of claim 14, wherein in the step of making corrections, the corrections are determined by calculations involving algorithms, the readings from the means for determining the volume of gas within the chamber and the depth measuring sensor, recalculations several times each second, and the results of previous correction.

* * * * *